US012584373B2

(12) United States Patent
Petersen et al.

(10) Patent No.: US 12,584,373 B2
(45) Date of Patent: Mar. 24, 2026

(54) CASING ATTACHMENT SYSTEM FOR ATTENUATING ANNULAR PRESSURE BUILDUP

(71) Applicant: ExxonMobil Technology and Engineering Company, Spring, TX (US)

(72) Inventors: Thomas A. Petersen, Houston, TX (US); Sudhin Datta, Houston, TX (US); Spencer A. White, Houston, TX (US); Andy J. Veselka, Houston, TX (US); William C. Morris, Jr., Magnolia, TX (US); Ward E. Narhi, Kingwood, TX (US)

(73) Assignee: ExxonMobil Technology and Engineering Company, Spring, TX (US)

( * ) Notice: Subject to any disclaimer, the term of this patent is extended or adjusted under 35 U.S.C. 154(b) by 250 days.

(21) Appl. No.: 17/995,026

(22) PCT Filed: Apr. 2, 2021

(86) PCT No.: PCT/US2021/025499
§ 371 (c)(1),
(2) Date: Sep. 29, 2022

(87) PCT Pub. No.: WO2021/207011
PCT Pub. Date: Oct. 14, 2021

(65) Prior Publication Data

US 2023/0235642 A1 Jul. 27, 2023

Related U.S. Application Data

(60) Provisional application No. 63/058,858, filed on Jul. 30, 2020, provisional application No. 63/006,579, filed on Apr. 7, 2020.

(51) Int. Cl.
*E21B 33/14* (2006.01)
*E21B 33/03* (2006.01)
*E21B 41/00* (2006.01)
*E21B 43/08* (2006.01)

(52) U.S. Cl.
CPC ..... *E21B 33/14* (2013.01); *E21B 33/03* (2013.01); *E21B 41/00* (2013.01); *E21B 43/08* (2013.01)

(58) Field of Classification Search
CPC ..... E21B 33/14; E21B 33/03; E21B 41/00; E21B 43/08; E21B 43/00
See application file for complete search history.

(56) References Cited

U.S. PATENT DOCUMENTS 4,160,813 A * 7/1979 Markel ..... C10B 19/00 423/DIG. 16
9,267,352 B1 * 2/2016 Smith ..... E21B 33/12955
(Continued)

FOREIGN PATENT DOCUMENTS

WO 2016164399 A1 10/2016

OTHER PUBLICATIONS

Guangjian Dong et al., "A review of the evaluation methods and control technologies for trapped annular pressure in deepwater oil and gas wells", Journal of Natural Gas Science and Engineering 37, 2017, pp. 85-105.

*Primary Examiner* — Nicole Coy
*Assistant Examiner* — Jennifer A Railey
(74) *Attorney, Agent, or Firm* — ExxonMobil Technology and Engineering Company—Law Department

(57) ABSTRACT

A method of attenuating annular pressure buildup within a wellbore. The method includes running first and second strings of casing into a wellbore, wherein the first string of casing surrounds an upper portion of the second string of
(Continued)

casing forming an annular region. The method also includes providing a packing of compressible material within the annular region. The compressible material comprises carbonaceous particles. The particles may reside within a porous sleeve or filter, or they may be packed together in a matrix using a cross-linked polymer or binder. The packing is fixed at a selected depth within the annular region, and is designed so that the compressible material absorbs pressure in response to thermal expansion of wellbore fluids during the production of hydrocarbon fluids from the wellbore. The method further includes placing a wellhead over the wellbore, thereby forming a trapped annulus in the wellbore over the annular region.

19 Claims, 10 Drawing Sheets

(56) References Cited

U.S. PATENT DOCUMENTS

| | | | | |
|---|---|---|---|---|
| 2007/0114033 | A1* | 5/2007 | Hermes | C09K 8/42 166/371 |
| 2011/0247835 | A1* | 10/2011 | Crabb | E21B 33/1208 166/387 |
| 2014/0262529 | A1* | 9/2014 | Quintero | C09K 8/528 175/69 |
| 2015/0184495 | A1* | 7/2015 | Zhou | C04B 38/009 166/310 |
| 2016/0138359 | A1* | 5/2016 | Zhao | C08K 3/041 277/316 |
| 2020/0148945 | A1* | 5/2020 | Narhi | E21B 43/08 |

* cited by examiner

CASING ATTACHMENT SYSTEM FOR ATTENUATING ANNULAR PRESSURE BUILDUP

CROSS REFERENCE TO RELATED APPLICATIONS

This application is the U.S. National Stage Application of International Application No. PCT/US2021/025499, entitled "Casing Attachment System for Attenuating Annular Pressure Buildup," filed on Apr. 2, 2021, which claims the benefit of U.S. Ser. No. 63/058,858, entitled "Casing Attachment System for Attenuating Annular Pressure Buildup," filed Jul. 30, 2020, which also claims the benefit of U.S. Ser. No. 63/006,579, entitled "Carbon Impregnated Foam/Rubber to Relieve Annular Pressure Buildup," filed on filed Apr. 7, 2020. Each of these applications is incorporated herein by reference in its entirety.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD OF THE INVENTION

The present disclosure relates to the field of hydrocarbon recovery operations. More specifically, the present invention relates to the drilling and completion of wells. Further, the invention relates to a method of placing compressible particles into a confined annular region within a wellbore in order to reduce pressure changes in response to thermal fluid expansion occurring during production.

TECHNOLOGY IN THE FIELD OF THE INVENTION

In the drilling of oil and gas wells, a wellbore is formed using a drill bit that is urged downwardly at a lower end of a drill string. The drill bit is rotated while force is applied through the drill string and against the rock face of the formation being drilled. After drilling to a predetermined depth, the drill string and bit are removed and the wellbore is lined with a string of casing.

In completing the wellbore, it is common for the drilling company to place a series of casing strings having progressively smaller outer diameters into the wellbore. A first string of casing is placed from the surface and down to a first drilled depth. This casing is known as surface casing. In the case of offshore operations, this casing may be referred to as a conductor pipe. One of the main functions of the initial string of casing is to isolate and protect the shallower, fresh water bearing aquifers from contamination by wellbore fluids. Accordingly, this casing string is almost always cemented entirely back to the surface.

One or more intermediate strings of casing is also run into the wellbore. Each successive pipe string extends to a greater depth than its predecessor, and has a smaller diameter than its predecessor. The process of drilling and then cementing strings of casing is repeated several times until the well has reached total depth.

A final string of casing, referred to as production casing, is placed along the pay zones. In some instances, the final string of casing is a liner, that is, a pipe string that is hung in the wellbore using a liner hanger. Frequently today, the final string of casing is a long pipe string that extends along a horizontal portion (or "leg") of a wellbore.

In most completion jobs today, especially those involving so called unconventional formations where high-pressure hydraulic operations are conducted downhole, the surface casing and perhaps the first intermediate string of casing are entirely cemented up to the surface. Hydraulic cements, usually Portland cement, are used to cement the tubular bodies within the wellbore. However, in some completions, particularly those where overlapping strings of casing extend to the surface, the operator may choose to leave an extended portion of certain intermediate casing strings without cement. This saves the drilling company time and the well operator money. However, this also means that upon completion an extended section of wellbore will have fluids residing on top of a column of cement up to the well head.

FIG. 1A is a cross-sectional view of a wellbore 100 undergoing completion. The wellbore 100 defines a bore 10 that has been drilled from an earth surface 105 into a subsurface 110. The wellbore 100 is formed using any known drilling mechanism, but preferably using a land-based rig or an offshore drilling rig on a platform. For deeper horizontal wells such as the one shown in FIG. 1A, the wellbore may be formed at least in part through the use of a downhole motor and measurement-while-drilling ("MWD") electronics.

The wellbore 100 is completed with a first string of casing 120, sometimes referred to as surface casing. The wellbore 100 is further completed with a second string of casing 130, typically referred to as an intermediate casing. In deeper wells, that is wells completed below 7,500 feet, at least two intermediate strings of casing will typically be used. In FIG. 1A, a second intermediate string of casing is shown at 140.

The wellbore 100 is finally completed with a string of production casing 150. In the view of FIG. 1A, the production casing extends from the surface 105 down to a subsurface formation, or "pay zone" 115. The wellbore 100 is completed horizontally, meaning that a horizontal "leg" 50 is provided. The leg 50 includes a heel 153 and a toe 154 along the pay zone 115. In this instance, the toe 154 defines the end (or "TD") of the wellbore 100.

It is observed that an annular region 122 around the surface casing 120 is filled with cement 125. The cement (or cement matrix) 125 serves to isolate the wellbore from fresh water zones and potentially porous formations around the casing string 120 and near the surface 105.

Annular regions 132, 142 around the intermediate casing strings 130, 140 are also filled with cement 135, 145. Similarly, an annular region 152 around the production casing 150 is filled with cement 155. However, the cement 135, 145, 155 is only placed behind the respective casing strings 130, 140, 150 up to the lowest joint of the immediately surrounding casing string, or cement shoe. Thus, a non-cemented annular area 132 is preserved above the cement matrix 135; a non-cemented annular area 142 is preserved above the cement matrix 145; and a non-cemented annular area 152 is preserved above the cement matrix 155.

FIG. 1B is an enlarged perspective view of the wellbore 100 of FIG. 1A, or at least the upper half of the wellbore 100. Here, casing strings 120, 130, 140 and 150 are again shown. In addition, cement matrices 125, 135, 145 and 155 are visible. Finally, non-cemented portions of annular areas 132, 142 and 152 are shown.

An annulus can be considered "trapped" if the cement pumping places the top of cement (or "TOC") higher than the previous shoe. Alternately, if the shoe remains open to the formation (not blocked by the cement), drilling mud particles and formation fines may settle out from the annular fluid, effectively plugging up the bottom of the annulus. In any instance, those of ordinary skill in the art will understand that the non-cemented portions of annular areas 132, 142, 152 are not unfilled above the TOC; rather, they are left with wellbore fluids at the end of completion. Such fluids may include drilling fluids, aqueous acid, and formation gas. When the well is completed, a wellhead (not shown) is placed over the annular areas 132, 142, 152, sealing these regions. For this reason each may be referred to as a "trapped annulus."

During the course of producing hydrocarbons, warm production fluids flow through a tubing string (shown at 160 in FIG. 5) up to the surface 105. These fluids raise the temperature inside the wellbore 100, including the fluids inside the one or more trapped annuli 132, 142, 152, causing thermal expansion. This, in turn, will increase the pressure within each trapped annulus. (Note that the effect of a trapped annulus is that the fluid in the annulus has no path to escape as the pressure rises.) This pressure can exceed the pressure ratings (burst or collapse pressures) of the inner strings of casing. For example, a trapped annulus can lead to pipe collapse and well failure.

Accordingly, a need exists for an improved wellbore design that can absorb burst or collapse pressure and mitigate thermal expansion within annular regions as wellbore temperature increases. Further, a need exists for a unique packing of compressible/collapsible particles capable of absorbing an increase in fluid pressure within a trapped annulus. A need further exists for a method of attenuating annular pressure buildup using compressible particles fixed at selected locations along a wellbore.

BRIEF SUMMARY OF THE DISCLOSURE

A method of attenuating annular pressure build-up in a wellbore is first provided herein. In one aspect, the method first comprises running a first string of casing into a wellbore. The first string of casing extends into a subsurface to a first depth.

The method additionally includes running a second string of casing into the wellbore. The second string of casing extends into the subsurface to a depth that is greater than the first depth. Each string of casing is preferably hung from a wellhead using a casing hanger, or within a previous casing string using a liner hanger. The first string of casing surrounds an upper portion of the second string of casing forming an annular region.

The method further comprises providing one or more packings of compressible material. Each of the packings is fixed at a selected depth within the annular region. This may be done by attaching the packings to the inner diameter of the first string of casing, or more preferably by attaching the packings to the outer diameter of the second string of casing.

The packings of compressible material may be secured to (i) an outer diameter of a joint along the second string of casing before the second string of casing is run into the wellbore, or (ii) threadedly connected to the second string of casing, in series. In either instance, the compressible material comprises a plurality of particles designed to absorb pressure in response to thermal expansion of wellbore fluids within the annular region. Thermal expansion occurs over time during the production of warm hydrocarbon fluids from the wellbore.

The method additionally includes placing a column of cement around the second string of casing below the first depth. Then, a wellhead is placed over the wellbore, thereby forming a trapped annulus in the wellbore over the annular region. A fluid mixture resides within the trapped annulus around the packing of compressible material.

Each packing comprises a plurality of compressible particles as the compressible material. Preferably, each of the particles has a reversible volumetric expansion/contraction or reversible volumetric of greater than or equal to (≥) 3% for pressure changes between 3,000 pounds per square inch (psi) and 10,000 psi (when acted upon by changes in hydrostatic fluid pressure between 3,000 psi and 10,000 psi). Preferably, each of the particles has a reversible volumetric contraction of ≥3% at pressures of 3,000 psi, and increasing up to 10,000 psi (when acted upon by a hydrostatic fluid pressure that is increased from 3,000 psi to 10,000 psi). Preferably, each of the plurality of particles comprises a carbonaceous material having a reversible volumetric expansion/contraction of ≥3% at pressure changes from 3,000 psi up to 10,000 psi (or at pressures in a range between 3,000 psi and 10,000 psi or when acted upon by a hydrostatic fluid pressure that is in a range between 3,000 psi and 10,000 psi). Further, each of the plurality of particles comprises a carbonaceous material having a reversible volumetric expansion/contraction of ≥3% for pressure changes from 15 psi up to 10,000 psi (or for pressures changes in a range between 15 psi and 10,000 psi or when acted upon by a change in hydrostatic fluid pressure that is in a range between 15 psi and 10,000 psi).

In one aspect, the packing of compressible material comprises carbon particles bound together within a matrix, forming a sheet. The compressible particles are held together within the matrix by means of a binder. The binder may be, for example, rubber, hydrogenated nitrile butadiene rubber (HNBR), nitrile butadiene rubber (NBR), and fluoroelastomer (FKM) or a soft plastic. The sheet may be wrapped around a joint of casing, forming a cylindrical body. The cylindrical body friction fits around or is adhesively attached to the joint of casing.

In another aspect, the packing of compressible material comprises: an elongated elastomeric sleeve placed along the outer diameter of the second string of casing; an upper collar securing the sleeve to the second string of casing at an upper end of the sleeve; and a lower collar securing the sleeve to the second string of casing at a lower end of the sleeve; and wherein the plurality of particles are held within the sleeve.

In another aspect, the packing of compressible material comprises: an elongated porous filter secured along the outer diameter of the second string of casing or threadedly connected in series with the second string of casing; and a plurality of compressible particles held within the filter.

The porous filter may be, for example, a rigid screen similar to a sand screen or a slotted liner. The filter may be between 5 feet (ft) and 35 feet in length.

In one aspect, each of the particles comprises a carbon core encased within a porous medium, or shell. Stated another way, the compressible particles may be a carbon sphere encapsulated within an open-celled foam or permeable rubber shell. More preferably, each of the compressible particles defines a body having an amorphous shape, and is fabricated from calcined coke or other carbonaceous material.

The compressible particles may have outer diameters that are between 40 micrometer (μm) and 1300 μm (in dry state) or between 100 micrometer (μm) and 900 μm (in dry state). A bundling of the compressible particles as part of the packing may have a compressibility response of between 10% and 30%, up to 10,000 psi, of between 10% and 30% at pressure changes in a range between 3,000 psi and 10,000 psi or between 10% and 30% when acted upon by a hydrostatic fluid pressure that is increased from 3,000 psi to 10,000 psi. Alternatively, the bundling of the compressible particles as part of the packing may have a compressibility response of between 10% and 30% for pressures in the range from 15 psi (atmospheric pressure) and 10,000 psi or between 10% and 30% when acted upon by changes in a hydrostatic fluid pressure that is from 15 psi to 10,000 psi.

In connection with the method, the following additional steps may be taken: selecting a depth for packings of compressible material in the annulus; determining a range of pressures expected to be experienced by the fluid mixture in the trapped annulus; and determining a maximum pressure for effectiveness of the compressible particles in the packings.

The method may also further comprise: placing a string of production tubing into the wellbore within the second string of casing; producing hydrocarbon fluids from the wellbore; and in response to thermal expansion of the fluid mixture in the trapped annulus, absorbing increased pressure using the compressible particles.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications. Further, the drawings may be referred to as "Figure" or "FIG." or "Figures" or "FIGS.", respectively.

FIG. 3A presents the filter as a filter screen that is similar to a sand screen.

FIG. 3B presents the filter as a slotted tubular.

DETAILED DESCRIPTION OF CERTAIN EMBODIMENTS

Definitions

Figure 1A:
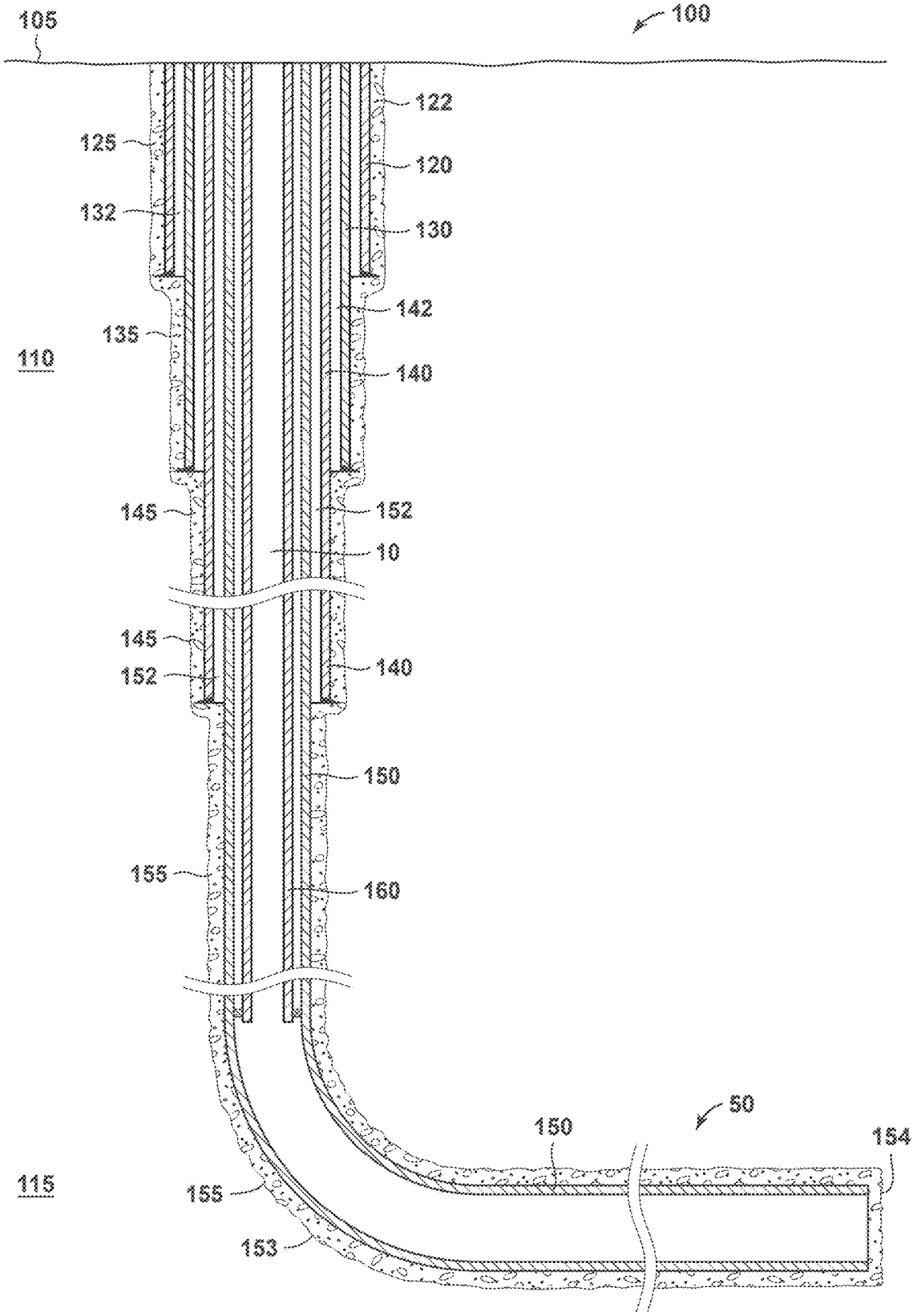
FIG. 1A (Prior Art)
FIG. 1A is a side view of a wellbore. The wellbore has a plurality of casing strings cemented into place, and is completed with a string of production casing.

For purposes of the present application, it will be understood that the term "hydrocarbon" refers to an organic compound that includes primarily, if not exclusively, the elements hydrogen and carbon. Hydrocarbons may also include other elements, such as, but not limited to, halogens, metallic elements, nitrogen, oxygen, and/or sulfur.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions or at surface conditions. Hydrocarbon fluids may include, for example, oil, natural gas, coalbed methane, shale oil, pyrolysis oil, pyrolysis gas, a pyrolysis product of coal, and other hydrocarbons that are in a gaseous or liquid state, or combination thereof.

As used herein, the terms "produced fluids," "reservoir fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, oxygen, carbon dioxide, hydrogen sulfide and water.

As used herein, the term "fluid" refers to gases, liquids, and combinations of gases and liquids, as well as to combinations of gases and solids, combinations of liquids and solids, and combinations of gases, liquids, and solids.

As used herein, the term "wellbore fluids" means water, hydrocarbon fluids, formation fluids, or any other fluids that may be within a wellbore during a production operation. Wellbore fluids may include a weighting agent that is residual from drilling mud.

As used herein, the term "gas" refers to a fluid that is in its vapor phase. A gas may be referred to herein as a "compressible fluid." In contrast, a fluid that is in its liquid phase is an "incompressible fluid."

As used herein, the term "subsurface" refers to geologic strata occurring below the earth's surface.

As used herein, the term "formation" refers to any definable subsurface region regardless of size. The formation may contain one or more hydrocarbon-containing layers, one or more non-hydrocarbon containing layers, an overburden, and/or an underburden of any geologic formation. A formation can refer to a single set of related geologic strata of a specific rock type, or to a set of geologic strata of different rock types that contribute to or are encountered in, for example, without limitation, (i) the creation, generation and/or entrapment of hydrocarbons or minerals, and (ii) the execution of processes used to extract hydrocarbons or minerals from the subsurface.

As used herein, the term "wellbore" refers to a hole in the subsurface made by drilling or insertion of a conduit into the subsurface. A wellbore may have a substantially circular cross section. The term "well," when referring to an opening in the formation, may be used interchangeably with the term "wellbore."

Description of Selected Specific Embodiments

Figure 1B:
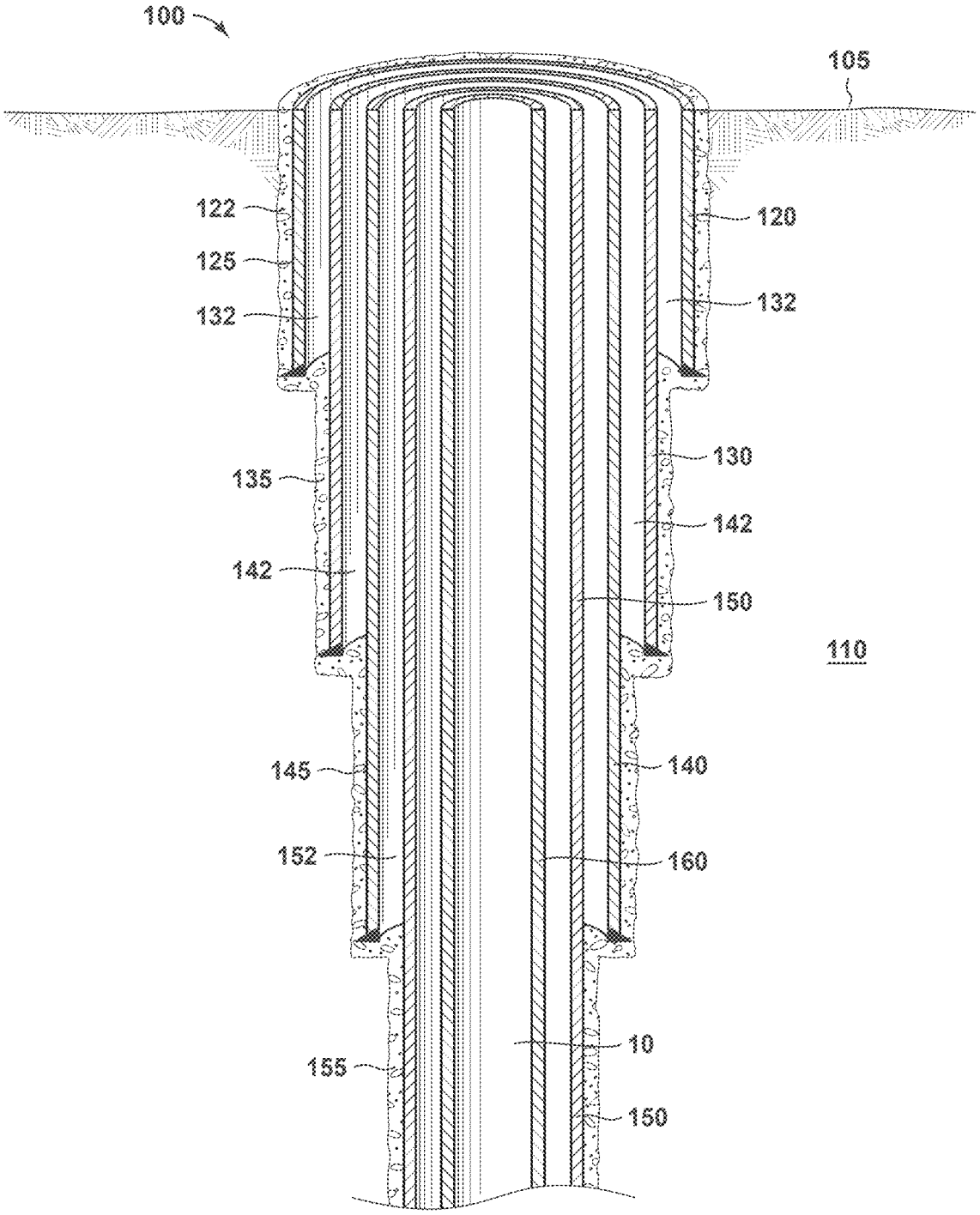
FIG. 1B (Prior Art)
FIG. 1B is a side perspective view of an upper half of the wellbore of FIG. 1A. Three annular regions are shown as trapped annuli.
Figure 2A:
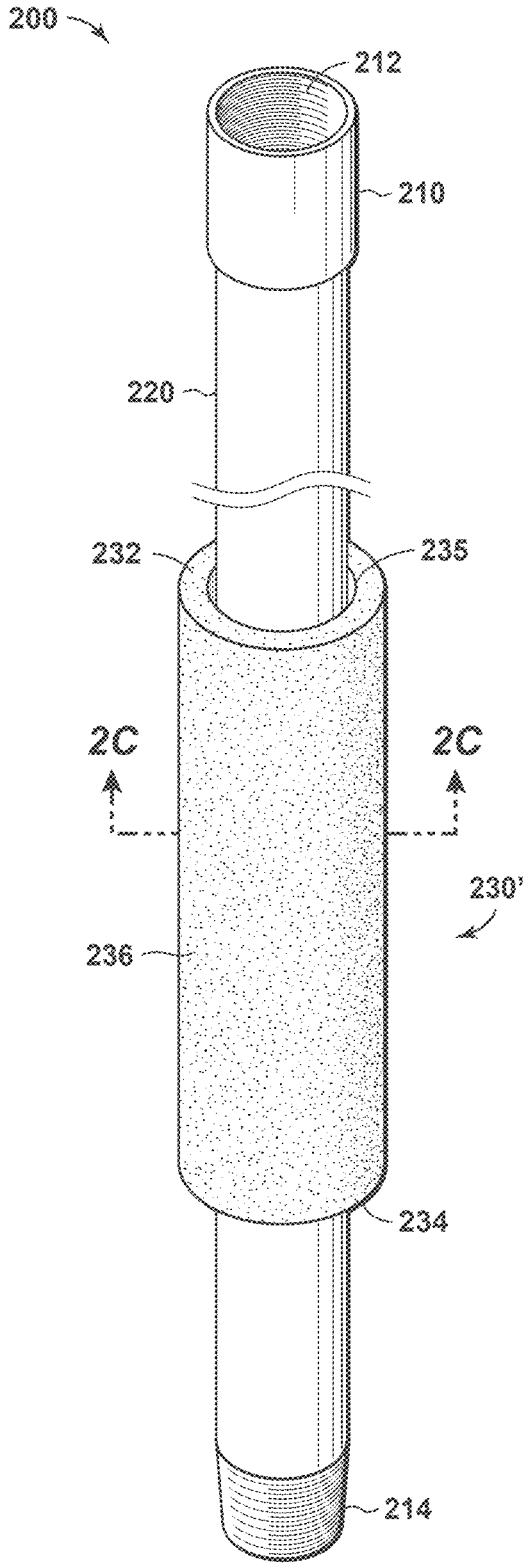
FIG. 2A is a perspective view of a tubular body (or joint of casing). A packing comprising a matrix of compressible particles is shown frictionally or adhesively engaging the casing. The matrix forms a sheet that can be wrapped around the pipe body.

FIG. 2A is a perspective view of a tubular body 200 of the present invention, in one embodiment. In a preferred aspect, the tubular body 200 is deployed in a wellbore as part of a string of casing. Stated another way, the tubular body 200 may be threadedly placed in series with a string of casing (such as casing string 140 of FIG. 1B).

The tubular body 200 is specifically designed to reside along an open annular region such as region 142. The tubular body 200 may be of a standard length for a pipe joint, such as 30 feet, 32 feet or even 40 feet.

The tubular body 200 comprises an upper end 210 and a lower end 214. In the vernacular of the industry, the upper end 210 is the box end while the lower end 214 is the pin end. The box end 210 comprises internal threads 212 that are configured to threadedly connect with the pin end of an immediately upper joint of pipe (not shown). Reciprocally, the pin end 214 is configured to "stab" into the box end of an immediately lower joint of pipe (not shown) for threaded connection.

The tubular body 200 defines an elongated wall forming a pipe 220 (or elongated pipe body). The pipe 220 may be fabricated from any steel material having burst and collapse pressure ratings suitable for a wellbore environment. Those of ordinary skill in the art will understand that with the advent of hydraulic fracturing, burst ratings of pipe (and particularly of production casing) are much higher than in older wells and may withstand pressures of up to 15,000 psi. As an alternative, the pipe body 220 may be fabricated from ceramic.

Placed along the outer diameter of the pipe 220 is a packing 230'. The packing 230' defines a matrix of compressible particles 236. Specifically, a plurality of carbon particles are held together by means of a cross-linked polymer or other binder, forming a sheet.

In the arrangement of FIG. 2A, the sheet of compressible particles 236 has been wrapped around the pipe 200, forming an elongated cylindrical body. The packing 230' has an upper end 232 and a lower end 234. Preferably, the packing 230' is at least five feet in length, and more preferably at least 20 feet in length.

In one aspect, a foam or rubber composite houses the compressible particles by impregnating them into a cross-linked polymer matrix. Alternatively, the binder is silicone, nitrile butadiene rubber (NBR), and fluoroelastomer (FKM) or hydrogenated nitrile butadiene rubber (HNBR), providing a compressible solid filler. Alternatively still, a thermoset or thermoplastic (or soft plastic) material is used as the binder.

Compared to the carbon particles, the polymer is soft and less compressible allowing it to effectively transmit stress onto the carbon particles collectively. This allows the porous matrix of the carbon particles to compress, providing additional volume for the fluid, surrounding the carbon-polymer composite in the annulus, to move into as it thermally expands or is otherwise strained. Beneficially, the sheet is inert to heated wellbore fluids.

The packing 230' may be formed as a thick, mechanically robust sheet of material. The packing 230' may be, for example, one to three centimeters in thickness. In one aspect, the compressible particles comprise an electro-thermally treated calcined petroleum coke. The coke may have small pores that are closed to fluid ingress, which allows them to compress when the fluid pressure surrounding the particles is increased. The particles are durable under repeated, cyclic loading and sustained loading at high pressure, providing reversible compressibility to fluid and particle mixture (or fluid particle mixture).

In a preferred embodiment, the particles making up the compressible particles 236 define a carbonaceous particulate material characterized by having a reversible volumetric contraction of greater than or equal to (≥) 3% from 3,000 psi and increasing up to 10,000 psi:

$$-\left(\frac{\Delta V}{V_0}\right) \geq 0.03$$

where: $V_0$=the initial volume of the particles, and $\Delta V$=the volume change of the particles (where positive value implies a positive change in volume).

In other words, as hydrostatic pressure on the particles increases from 3,000 psi up to 10,000 psi, the particles will volumetrically compress by at least 3% of their initial volume, where the initial volume is the volume of the particles when measured at a hydrostatic pressure of 3,000 psi.

The material is further characterized by being inert to production fluids. Further technical details of a suitable compressible particle are described in U.S. Pat. No. 9,458,703 issued to Superior Graphite Co., of Chicago, Illinois. The '703 patent is incorporated herein by reference in its entirety.

Figure 2B:
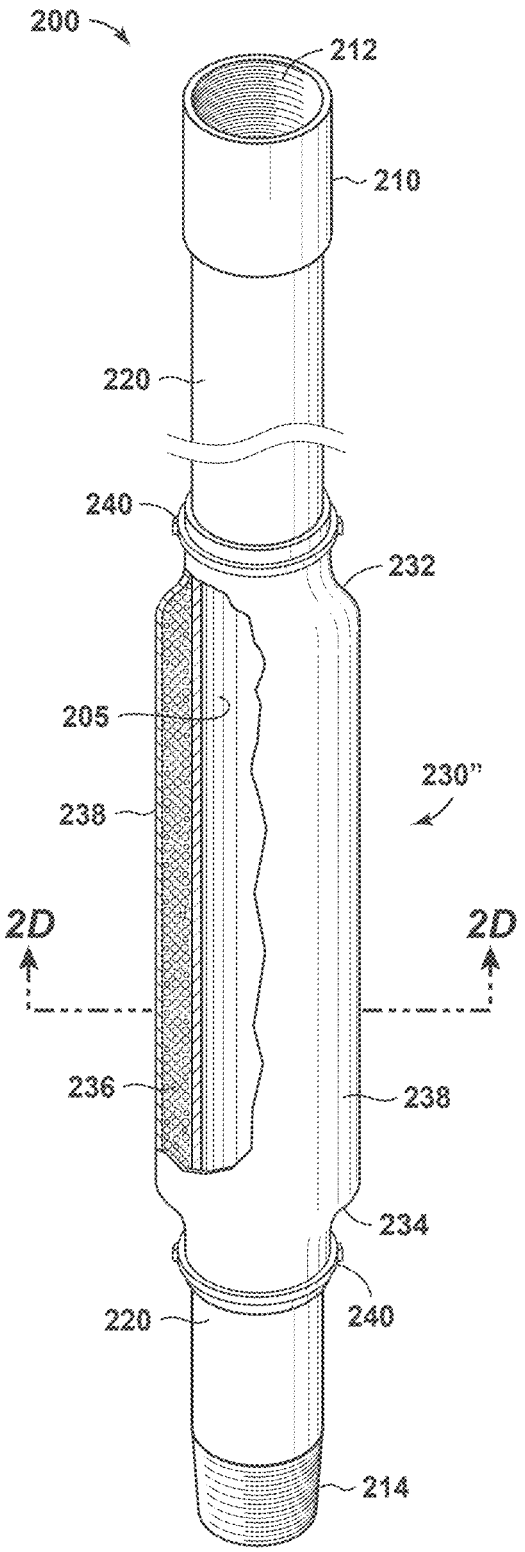
FIG. 2B is a perspective, cut-away view of a packing of compressible materials in a second embodiment. Here, a polymeric sleeve has been placed around compressible particles and secured to the outer diameter of a pipe body.
Figure 2C:
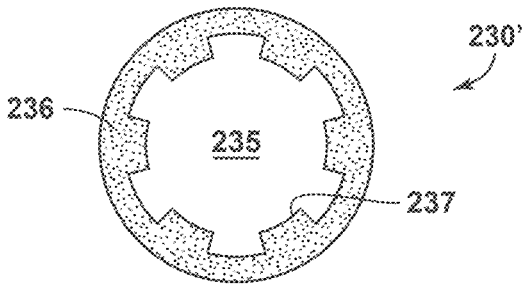
FIG. 2C is a cross-sectional view of the packing of FIG. 2A, taken across Line 2C-2C.

FIG. 2C is a cross-sectional view of the packing 230' of FIG. 2A, taken across Line 2C-2C. In this view, it can be seen that the packing 230' has a generally cylindrical profile. A central opening 235 is provided in the packing 230'. The central opening 235 is dimensioned to closely or frictionally receive the pipe 220. To facilitate a frictional engagement, a series of equi-radially spaced spokes 237 is provided, extending inward to the opening 235. The frictional engagement is sufficiently tight to ensure a mechanical connection that will not slide along the tubular body 200.

In one embodiment, the compressible particles 236 are adhered to the outer surface of the pipe 220. This may be done by using the same cross-linking polymer or binder that secures the compressible particles themselves together. A durable polymer matrix is formed that is structurally robust so as to endure the abrasion encountered when running the casing and to not permit slippage of the particles 236 from the pipe 220.

It is preferred that the matrix be cylindrical as depicted in FIGS. 2A and 2C. However, in another aspect the matrix is in the form of elongated rods that are adhesively secured to the outer diameter of the pipe body 220.

As an alternative to a packing in the form of a sheet, a packing may take the form of a sleeve that encapsulates the compressible particles 236. FIG. 2B is a perspective, cutaway view of a packing 230" in an alternate embodiment. Here, the packing 230" defines an elongated, sleeve 238 that holds the compressible particles 236 in place. The sleeve 238 may be fabricated from any elastomeric material, such as a polymer or polymer composite.

In FIG. 2B, the particles 236 are again fitted onto an elongated pipe joint 220. An inner bore 205 of the pipe 220 can be seen. However, in this embodiment the particles 236 are wrapped in an annular sleeve 238, forming a packing of compressible materials 230" in a second embodiment. Sufficient clearance around the sleeve 238 is provided to enable the circulation of drilling fluids up the annulus during completion.

The sleeve 238 may be fabricated from a relatively stiff polymeric material. Suitable polymeric materials may include neoprene, polyurethane rubber, vinyl, nitrile rubber, butyl rubber, silicone rubber, or combinations thereof. Alternatively or in addition, the sleeve 238 may be held in a taut position by means of the opposing clamps 240. Of course, when securing the clamps onto the outer diameter of the pipe body 220 care must be taken not to compromise the integrity of the joint 200 as a pressure vessel by scoring the pipe 220. Alternatively, the sleeve 238 may be secured to the outer diameter of the pipe body 220 by a suitable, high-temperature tolerant adhesive.

It is preferred that the polymeric material of the sleeve 238 not expand substantially upon being heated during production. If there is expansion, such should be primarily due to ingress of fluid into the pore spaces between polymer chains that increase in volume upon increasing the temperature. Thus, the volume change of the bulk expansion of the polymeric sleeve 238 is compensated by a similar increase in volume within its fluid-accessible pore space.

In either instance, as wellbore fluids within the annular region expand, pressure will be applied against the outer surface of the sleeve 238. In this way, the sleeve 238 has a degree of compliance. The sleeve 238 then transmits that pressure against the compressible particles 236 within the sleeve 238. In this way pressure that is built up in the annulus is absorbed.

Figure 2D:
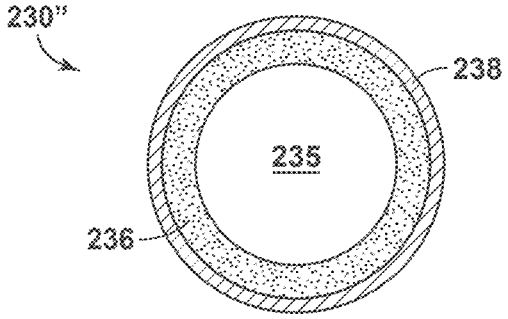
FIG. 2D is a cross-sectional view of the packing of FIG. 2B, taken across Line 2D-2D.

FIG. 2D is a cross-sectional view of the packing 230" of FIG. 2B, taken across Line 2D-2D. Here, the optional spokes 237 are omitted; however, it is understood that the spokes 237 of FIG. 2C may still be employed. More preferably, the packing 230" is secured to the outer diameter of the pipe body 220 by means of clamps 240 around the top 232 and bottom 234 ends.

Figure 2E:
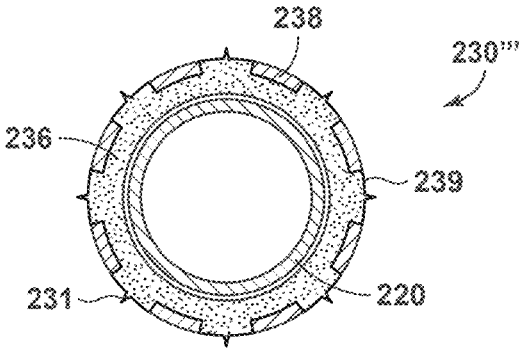
FIG. 2E is a cross-sectional view of the packing of FIG. 2B, in an alternate embodiment.

FIG. 2E is a cross-sectional view of the packing of FIG. 2B, in an alternate embodiment 230'". Here, a plurality of compressible particles 236 are formed to have a star-shaped profile. Outward-facing spokes 239 are shown equi-distantly spaced about the compressible particles 236. The elastomeric sleeve 238 fits snuggly between outward spokes 239 of the particles 236. Optional tips 231 extending out from the spokes 239 help centralize the packing 230" within the annular region 142.

It is noted that in FIG. 2E, the pipe body 220 is also shown in cross-section. This is for illustrative purposes.

In either FIG. 2D or 2E, the outer sleeve 238 of the packing 230 is designed to hold a cylindrical shape around the matrix of particles 236 until a designated annular pressure is reached. Typically, compression will not begin to occur until a pressure of at least 3,000 psi is felt. Once the designated annular pressure is reached, the sleeve 238 will begin to collapse. As annular pressure continues to increase, pressure is transmitted to the matrix of particles 236, thereby absorbing pressure within the annular region 142 and reducing the likelihood of the pipe 220 collapsing during production operations.

In an alternate embodiment, the packing uses a more rigid outer medium, particularly a filter screen. In this embodiment, the particles need not be bound together into a cross-linked polymer matrix as in FIG. 2A or 2B; instead, the particles 236 are tightly held in place along the tubular body 200 by mechanically affixing a porous screen to the outer diameter of the pipe 220.

Figures 3A, 3B:
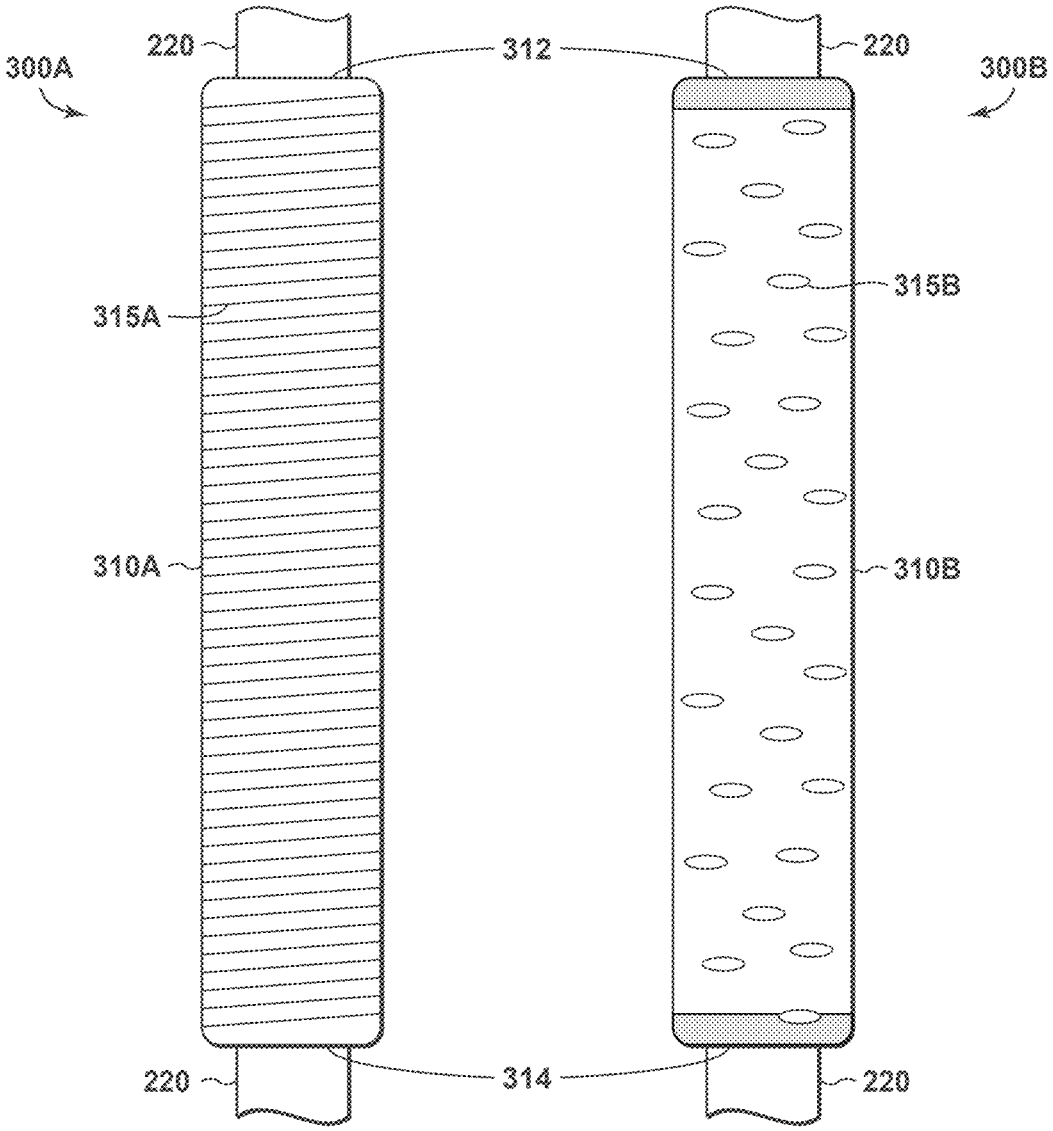
FIGS. 3A and 3B present side views of packings of compressible particles in alternate embodiments. Instead of using a compliant, polymeric sleeve, a rigid filter is provided around the particles.

FIGS. 3A and 3B present alternate embodiments of suitable annular filter screens as packings. FIG. 3A presents the screen as a wound filter screen 300A. The filter screen 300A is similar to a known sand screen. The filter screen 300A may be fabricated from either steel (or any corrosion-resistant alloy) or ceramic. Preferably, the filter screen 300A is fabricated from metal wire 310A that is wound around and supported by elongated vertical ribs (not visible). Microslots 315A are preserved between the wire 310A to enable pressure communication into the containment area.

FIG. 3B presents the filter screen 300B as a slotted tubular body. The filter screen 300B defines a metal tubular body 310B with a plurality of dedicated slots 315B. The slots 315B again enable pressure communication into the containment area.

Each filter screen has an upper end 312 and a lower end 314. The filter screens 300A or 300B are designed to be fitted around an outer diameter of the pipe 220 and filled with compressible particles. Each filter screen 300A or 300B will present slots 315A, 315B that permit fluid and pressure communication between the wellbore and the compressible particles. The gap size of the slots 315A, 315B in the screens 300A, 300B may range in size from 10 micrometers or microns (μm) to 100 μm, depending on the specific particle size distribution. At the same time, the particle size distribution may range between 40 micrometer (μm) and 1300 μm (in dry state) or between 100 μm and 900 μm (dry).

The preferred median diameter for the compressible carbon is between 300 microns and 500 microns. In one aspect, about 10% of the particles have a diameter that is over 700 microns, or over 800 microns. It is understood that the gaps 315A, 315B must be smaller than the smallest of the diameters of the compressible particles.

In the arrangements of FIGS. 3A and 3B, the screens 300A, 300B are considered to be rigid. This protects the integrity of the compressible particles residing within an area of containment within the screens 300A, 300B and around the pipe body 220. The outer diameters of the screens 300A, 300B are dimensioned such that an annular space is preserved that permits drilling fluids to pass within the inner diameter of a surrounding casing string during completion.

Figure 4A:
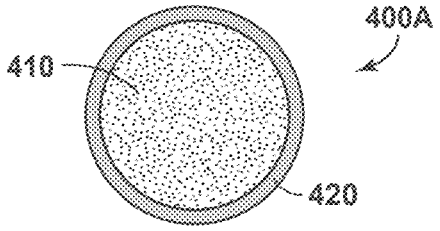
FIG. 4A is a cross-sectional view of a compressible particle that may be placed in the filters of FIGS. 3A and 3B, in one embodiment. Here, the compressible particle has a spherical core residing within a shell.

FIG. 4A provides a cross-sectional view of a compressible particle 400A as may be used in the annular filter screens 300A, 300B. The compressible particle 400A has a spherical core 410. The core 410 is fabricated from a carbon material.

The spherical core 410 is encapsulated within a shell 420. The shell 420 may be either an elastomeric material or a foam material.

The core 410 may comprise a petroleum coke that is heat treated. The starting material is commercially known as "Calcined Petroleum Coke-Medium High Sulfur." In some designs the maximum sulfur content of the starting material may be as high as 8%. The starting material is heat-treated in a fluidized bed furnace, such as that shown and described in U.S. Pat. No. 4,160,813, incorporated herein by reference. The resultant material comprises a carbonaceous particulate material having a substantially reduced sulfur content, and that has a reversible volumetric expansion/contraction in a fluid media of greater than or equal to (≥) 3% for pressure changed between 3,000 psi (20.7 MegaPascal (MPa)) and 10,000 psi (68.9 MPa). This means that the resultant material can be repeatedly subjected to pressures between 3,000 psi and 10,000 psi and "rebound" to its original volume.

Figure 4B:
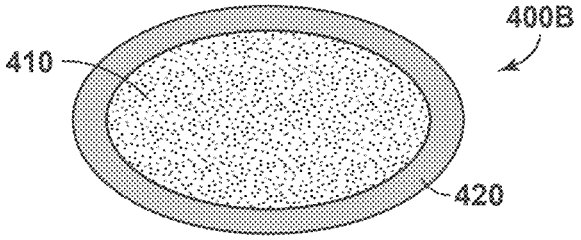
FIG. 4B presents a cross-sectional view of a compressible particle in an alternate embodiment. Here, the core and surrounding shell have an oval profile.

In the arrangement of FIG. 4A, the compressible particle 400A is spherical in shape. However, the particle may alternatively be more ovoid or angular in shape. FIG. 4B presents a cross-sectional view of a compressible particle 400B in an alternative arrangement. Here, the core 410 and surrounding shell 420 have an oval profile.

Figure 4C:
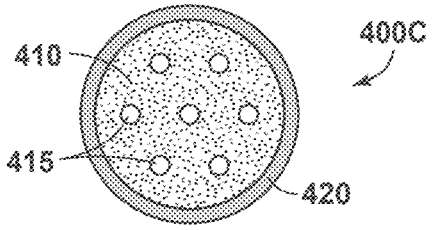
FIG. 4C presents yet another cross-sectional view of a compressible particle. Here, the core contains a plurality of small holes to enhance porosity and compressibility.

FIG. 4C presents yet another cross-sectional view of a compressible particle.

Here, the core 410 contains a plurality of small holes 415. The holes 415 enhance porosity and compressibility. Further, increasing the number of holes 415 increases porosity and compressibility response.

As may be appreciated, the compressible particles may have various shapes and may include gaps or holes that are sealed from external fluids (internal to the particles). As an example, the compressible particles may be shapped similar to coarse sand or have different irregular polygonal shapes.

A sufficient number of compressed particles 236 or 400 are used to fill the screens 310A, 310B around the pipe body 220. As the annular pressure builds up, the compressible particles 400 will begin to collapse, thereby absorbing pressure within the annular region 142 and reducing the likelihood of the pipe 220 collapsing during production operations.

In an alternate aspect, the screen 310A or 310B may be fabricated from a compliant polymeric material having slits. In this instance, when the designated annular pressure that causes compression or collapse of the compressible particles 400 is reached, the porous, polymeric body may at least partially collapse around the compressed particles 400. Preferably, the collapsibility response (or pressure rating) of the particles 400 is less than the collapsibility response (or pressure rating) of the screen, though this is a matter of engineer's choice.

It is observed that where the screen 310A or 310B is fabricated from a lower strength material, the porous filter will have collars at upper and lower ends, such as the collars 240 shown in the embodiment of FIG. 2B. The collars 240 help secure the screen to the joint of casing/pup joint when running casing 220 downhole.

In one aspect, the particles 236 or 400 are fabricated from a compressive carbon such as mesocarbon micro-beads or graphite as described above. Alternatively, a composite of polymer and graphite may be formed into beads. The graphite material may include graphite carbons. Such materials are available from Superior Graphite Co. of Chicago Illinois. Alternatively, graphene beads having a high porosity to enhance compressibility may be used. Pore channels within the beads may optionally be coated with natural rubber or a polymer or pseudo-polymer serving as a synthetic rubber.

In one arrangement, flexible compressible beads comprised of a polymeric material are used. For example, a co-polymer of methylmethacrylate and acrylonitrile may be used. Styrofoam or polystyrene may also be used alone or in combination with this co-polymer. In another embodiment, a terpolymer of methylmethacrylate, acrylonitrile and dichloroethane is used. The dichloroethane may be a vinylidene dichloride. Preferably, the beads are not infused with gas so as to limit expansion of the bead material upon exposure to heat during wellbore operations.

Preferably, the collection of particles has a compressibility response of between 10% and 30% when acted upon by a hydrostatic fluid pressure that increases from 3,000 psi to 10,000 psi or from 15 psi to 10,000 psi. More preferably, the collection of particles will have a compressibility response of between 15% and 22% when acted upon by a hydrostatic fluid pressure that increases from 3,000 psi to 10,000 psi or 15 psi (atmospheric pressure) to 10,000 psi.

Preferably, each of the particles has a resiliency of between 80% and 120%. More preferably, each of the particles has a resiliency of between 87% and 117%.

Placement of any of the packings 230', 230", 300A or 300B along the casing in a wellbore enables the delivery of compressible particles 400 within a "trapped annulus." Using the packings described above, it is not necessary to pump compressible particles 400 ahead of a cement column (e.g., column 145) for placement within the annular area (e.g., annular area 142). Instead, the particles are run into the wellbore with the casing and are placed at pre-designed depths for optimum mitigation of pressure.

The use of the tubular body 200 with a packing 230 or a screen 300A or 300B enables the operator to place the particles 236 or 400 in a specific location in the trapped annulus. For example, the operator may desire to keep the compressible particles central to the trapped annulus. In this instance, the operator may place one or more packings 230, 300A or 300B in series, generally halfway between the top and the bottom of the fluid column making up the trapped annulus.

In addition, the operator may adjust the compressibility response of the packings by extending or reducing the length of the packings 230', 230", 300A or 300B and/or increasing or reducing the compressibility of the particles 400 used and/or increasing or reducing the number of packings 230', 230", 300A or 300B in the wellbore within a trapped annulus 142, 152.

It is preferred that the packings 230', 230", 300A, 300B cover about 80% of the length of the pipe body 220. The operator may place one, two, ten or even twenty tubular bodies 200 having the packings 230', 230", 300A, 300B along an annular region, e.g., annular area 142. The tubular bodies 200 may be connected in series, or may be spaced apart by placing standard casing joints between tubular bodies 200.

Figure 5:
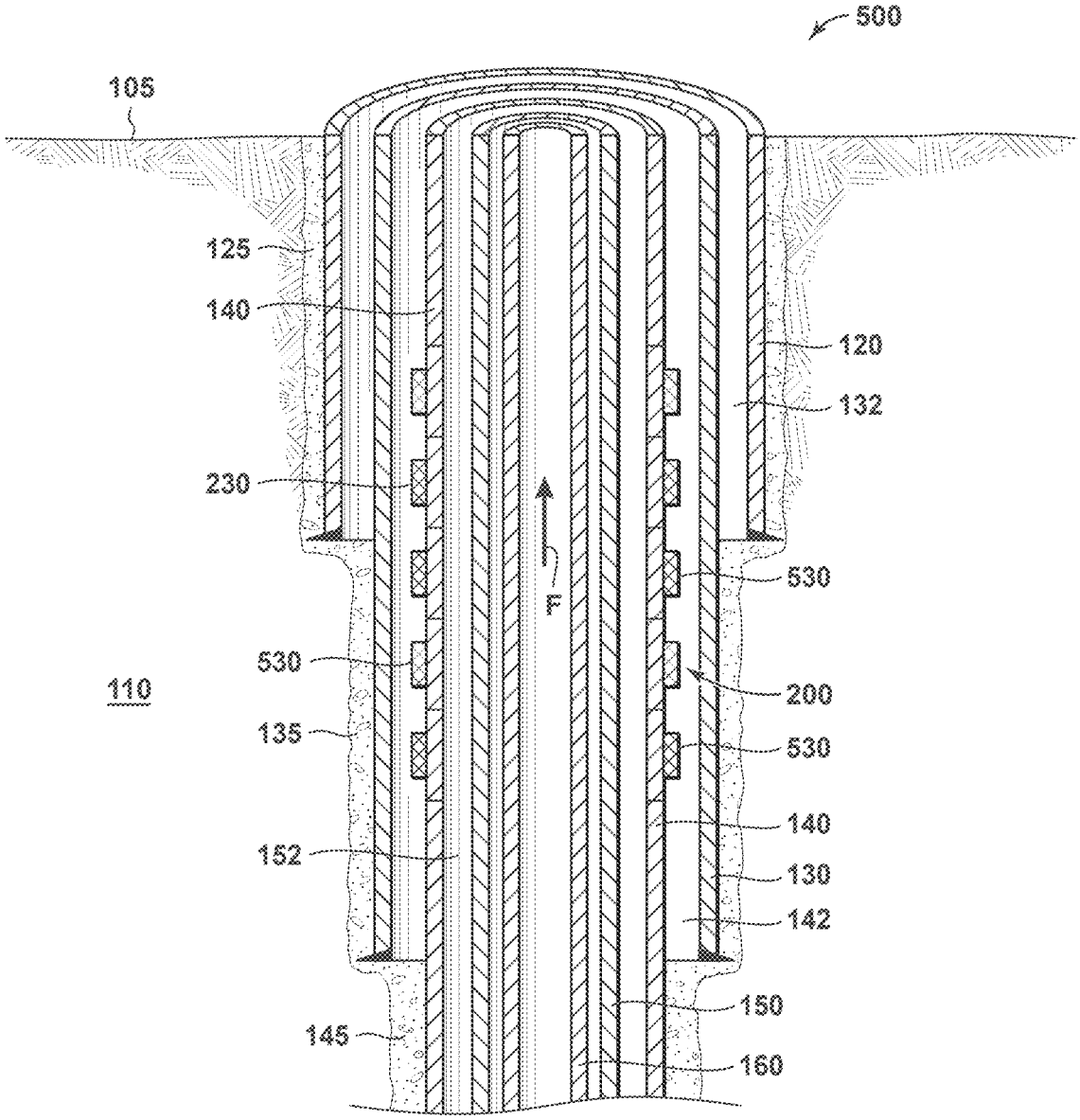
FIG. 5 is a perspective view of the upper portion of a wellbore having trapped annuli. An intermediate string of casing has received a series of packings of compressible particles, such as the packing of FIG. 2B or either of the rigid filters of FIG. 3A or 3B with the particles therein.

FIG. 5 is a perspective view of the upper portion of a wellbore 500. The wellbore 500 is in accordance with the wellbore 100 of FIG. 1B. In this respect, the wellbore 500 is completed with a series of casing strings including surface casing 120, intermediate casing strings 130 and 140, and production casing 150.

In FIG. 5, Arrow F is shown. This indicates a flow of production fluids during a hydrocarbon production operation. The production fluids are produced through a production string 160 known as production tubing. Formation fluids may flow to the surface 105 under in situ pressure; alternatively, formation fluids may be raised to the surface 105 using an artificial lift technique. The production fluids "F" are warm, causing a temperature within the various annular regions 132, 142, 152 to increase. This, in turn, will increase the temperature of the fluids within these annular regions 132, 142, 152, causing thermal expansion. The increase in temperature within the defined volumes will cause a corresponding increase in pressure, referred to as annular pressure build-up, or APB.

To mitigate APB and to prevent casing string 140 from collapsing (or to prevent casing string 130 from bursting), a series of packings 530 is shown. The packings 530 are affixed around the outer diameter of selected joints of casing along casing string 140. This is illustrative as it is understood that packings 530 may alternatively be placed along the inner diameter of casing string 140. It is also understood that packings 530 may be placed along the outer diameter of casing strings 120 and 150—or wherever there is a trapped annulus.

The packings 530 shown in FIG. 5 may be in accordance with any of the packing embodiments shown in FIGS. 2A through 2E. Alternatively, the packings 530 shown in FIG. 5 may be in accordance with either of the packing embodiments shown in FIG. 3A or 3B. Based on these embodiments, a method of attenuating annular pressure buildup in a wellbore is provided herein.

Figure 6:
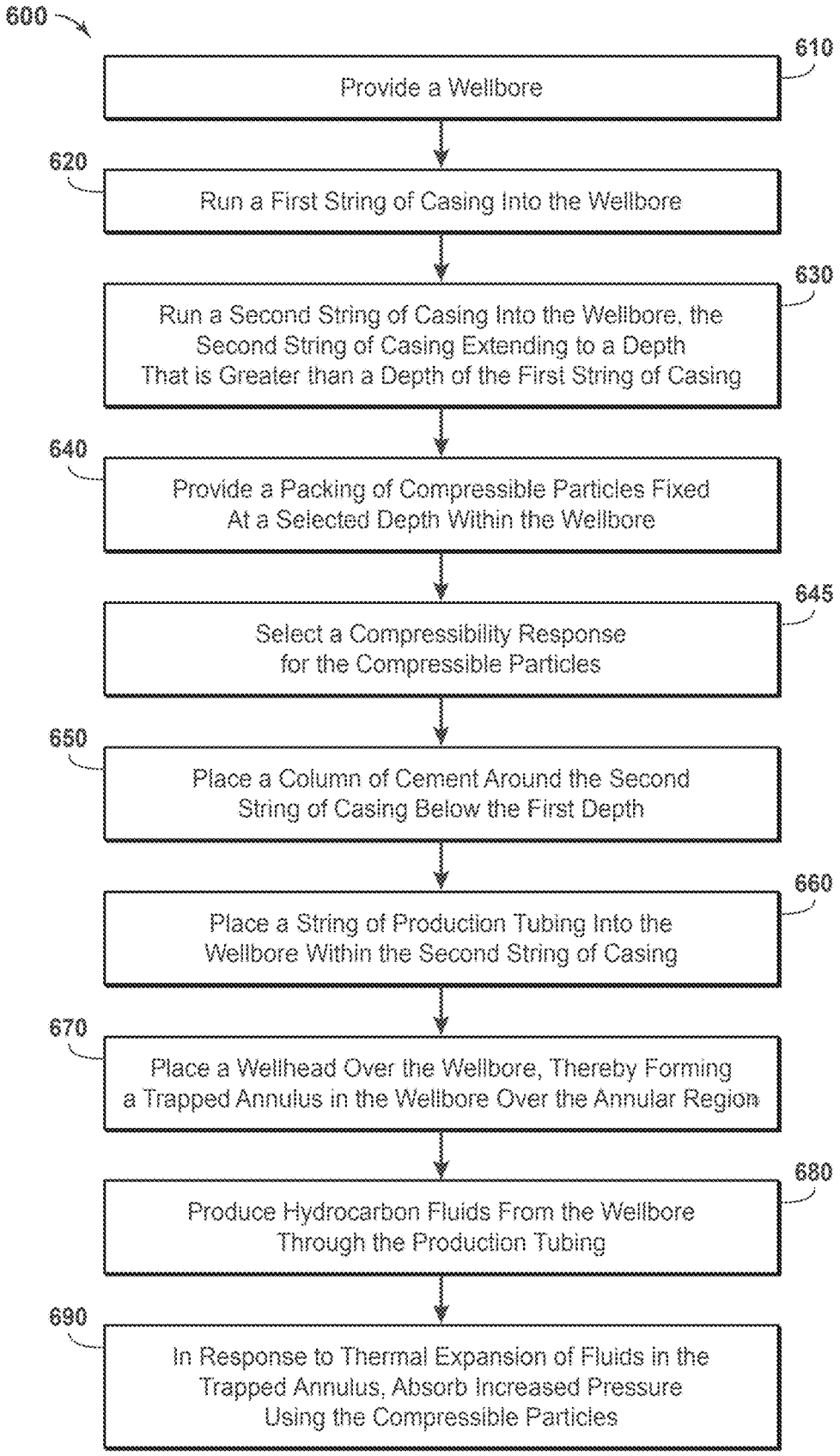
FIG. 6 represents a single flow chart showing steps for a method of attenuating pressure in an annular region.

FIG. 6 presents a flow chart showing steps for a method 600 of attenuating pressure in an annular region.

In one aspect, the method 600 first comprises providing a wellbore. This is shown at Box 610. The wellbore may be any wellbore that is completed with at least two, and more likely at least three, strings of casing (not including conductor pipe).

The method 600 also includes running a first string of casing into the wellbore. This is provided at Box 620. The first string of casing extends into a subsurface to a first depth. Note that "first string" is a relative term; this does not mean that it is the first string that is run into the wellbore, but only that it is first relative to a second string.

The method 600 additionally includes running a second string of casing into the wellbore. This is seen at Box 630. The second string of casing is run into the wellbore after the first string, and extends into the subsurface to a depth that is greater than the first depth. The second string of casing is preferably hung from a wellhead using a liner hanger. The first string of casing surrounds an upper portion of the second string of casing forming an annular region.

In one aspect, each of the first and second strings of casing is an intermediate casing string. In another aspect, the first string of casing is an intermediate string of casing while the second string of casing is a production casing.

The method 600 further comprises providing a packing of compressible material. This is offered in Box 640. The compressible material is fixed at a selected depth within the annular region. This may be done by attaching the packing of compressible material to the inner diameter of the first string of casing, or more preferably by attaching the packing of compressible material to the outer diameter of the second string of casing. It is noted that fixing the compressible material may mean mechanically or adhesively connecting the packing to a string of casing.

In one aspect, a plurality of packings are spaced apart along the second string of casing. The operator may select a number of packings to be used, the length for the packings, or the spacing of the packings within the wellbore. All of this is to optimize a compressibility response of the compressible material.

The compressible material comprises a plurality of individual parties. Each particle is designed to absorb pressure in response to thermal expansion of wellbore fluids within the annular region. Thermal expansion occurs over time during the production of warm hydrocarbon fluids from the wellbore.

In one aspect, the packing of compressible material comprises: an elongated elastomeric sleeve placed along the outer diameter of the second string of casing; an upper collar securing the sleeve to the second string of casing at an upper end of the sleeve; a lower collar securing the sleeve to the second string of casing at a lower end of the sleeve; and a plurality of particles held within the sleeve.

Preferably, each of the plurality of particles comprises a carbonaceous particulate material. The particles together have a reversible volumetric contraction of ≥3% when acted upon hydrostatically by a fluid pressure that increases from 3,000 psi up to 10,000 psi. More preferably, the plurality of compressible particles together have a reversible volumetric contraction of ≥3% as pressure increases from atmospheric pressure (15 psi) up to 10,000 psi.

Each of the particles has a compressibility response of between 10% and 25%, up to 10,000 pounds per square inch (psi). Stated another way, the particles strain between 10% and 25% when pressured from atmospheric pressure conditions (15 psi) up to 10,000 psi. Note that for purposes of the present disclosure, the term "compressibility response" means a reversible volumetric expansion/contraction, that is measured in terms of percentages. That is, the contraction is measured as a percentage of the initial particle volume at low pressure. This encompasses the idea of particle strain.

In another aspect, the packing of compressible material comprises: an elongated porous sleeve secured along the outer diameter of the second string of casing, or threadedly connected in series with the second string of casing; and a plurality of compressible particles held within the sleeve.

The porous sleeve may be, for example, a wound screen or a slotted tubular body. Once again, the compressible particles may have a reversible volumetric expansion/contraction of ≥3% as pressure increases from 3,000 psi up to 10,000 psi.

The compressible particles may be carbonaceous materials comprising calcined petroleum coke and sulfur. Alternatively, the compressible particles may comprise a carbon core encased within a porous shell. The porous shell may be, for example, an open-celled foam or permeable rubber.

The compressible particles may have outer diameters that are between 40 micrometer (μm) and 1300 μm (in dry state) or between 100 μm and 900 μm (in dry state). The compressible particles together may have a compressibility response of between 10% and 30%, when pressure changes from atmospheric pressure (15 psi) up to 10,000 psi.

As part of Box 640, the method may further comprise securing the packing of compressible material to an outer diameter of a joint along the second string of casing before the second string of casing is run into the wellbore. The packing of compressible material may be, for example, between 5 feet and 25 feet in length. Where longer joints of casing (such as 40 feet) are used, a packing may be 30 feet or even 35 feet in length.

The method 600 may include selecting a compressibility response for the compressible particles. This is shown in Box 645. The compressibility may be measured at a given fluid pressure, P, in terms of volumetric change per pressure change as:

$$\left(-\frac{1}{V_0}\frac{dV}{dP}\right)$$

with units as 1/psi; and where: $V_0$=the initial volume, dV=infinitesimal change in particle volume (where positive value implies a positive change in volume); and dP=infinitesimal change in pressure acting on the particles.

The compressibility response of the particles is the integration of their compressibility between two pressure points, $P_0$ and $P_1$, $$\int_{P_0}^{P_1} -\left(\frac{1}{V_0}\frac{dV}{dP}\right)dP = -\frac{\Delta V}{V_0}$$

where $P_0$ is the initial fluid pressure acting on the particles, $P_1$ is the final fluid pressure acting on the particles, and $\Delta V$ is the total increase in volume of the particles measured between $P_0$ and $P_1$.

In other embodiments, various modifications may occur for the method described in FIG. 6. As an example, the providing a packing of compressible particles fixed at a selected depth within the wellbore, as shown in block 640 and selecting a compressibility response for the compressible particles, as shown in block 645, may be performed prior to running the second string of casing into the wellbore, as shown in block 630. In such a process, the securing the packing of compressible material to an outer diameter of a joint along the second string of casing before the second string of casing is run into the wellbore, as shown in block 640 and as shown in block 645 may be performed prior to precede 630. That is, the packing of particles may be affixed to the second string of casing prior to or during the running of the second string of casing. Further, in other embodiment, as may be appreciated, the particle compressibility may be designed or engineered to the hydrostatic pressure conditions to be encountered downhole. As such, the particle compressibility may selected to provide a specific compressibility based on the estimated hydrostatic pressure conditions.

Figure 7A:
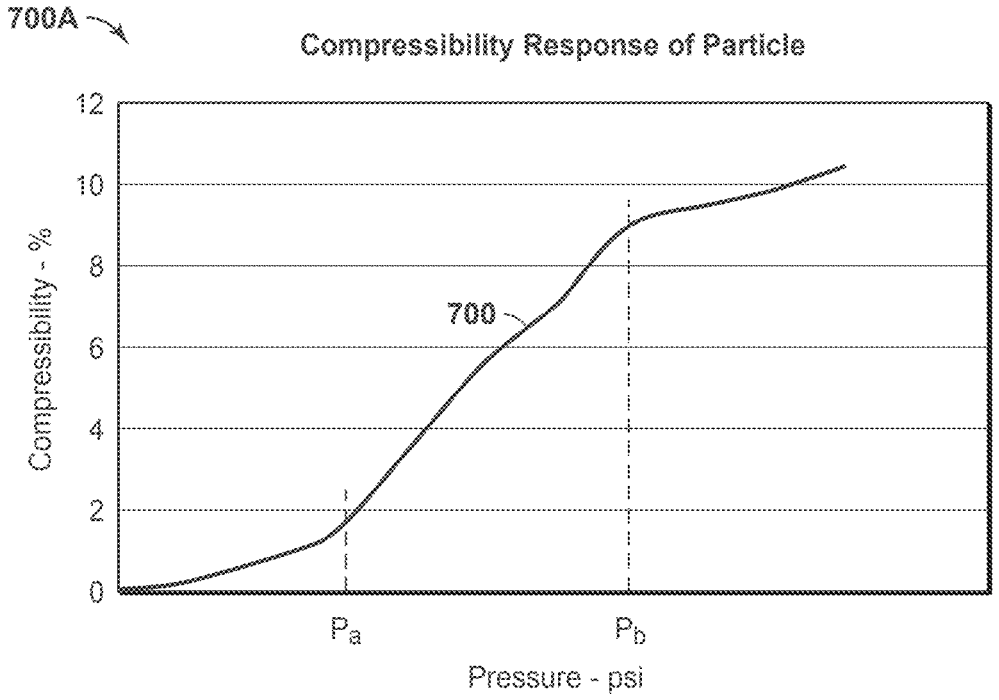
FIG. 7A is a Cartesian chart showing compressibility of particles as a function of pressure. This demonstrates a "compressibility response."

FIG. 7A is a Cartesian chart 700A showing a compressibility of a particle. Compressibility is indicated along the y-axis as a percentage of volumetric change, while pressure (measured in psi) is shown on the x-axis. Line 700 demonstrates a compressibility response, or volumetric change (e.g., volumetric expansion/contraction), of the particle as pressure increases. It is noted here that for purposes of reducing a pressure response within a trapped annulus, the term "compressibility response" refers to a volume strain on a collection of particles within a packing, or to the overall volume percent reduction. Individually, some particles will compress more than others.

To maximize the effectiveness of compressible particles, the pressure acting on those particles ideally would be within the area of a compressibility curve that maximizes the volumetric change per pressure change (|dV/dP|). In FIG. 7A, this resides within $P_A$ and $P_B$.

When fixed along an annulus, the compressible particles should be designed such that the predicted pressure P at the position of placement is within the maximum −dV/dP capabilities of the particles. This would be within the range between $P_a$ and $P_b$ of FIG. 7A. $P_a$ may be the initial pressure state of the annulus before the annulus builds up pressure. $P_b$ represents a final pressure state of the annulus after productions operations have commenced and the wellbore has warmed.

The depth of this pressure range $P_a$-$P_b$ can be found by calculating the expected pressure profile within the annulus. The end result of this is that compressible particles are placed to maximize the effectiveness of their compressibility response.

In other examples, the change in the compressibility response may be between in a range between 10% and 30% for the pressure changes between Pa and Pb; in a range between 10% and 25% for the pressure changes between Pa and Pb or in a range between 10% and 20% for the pressure changes between Pa and Pb. Other embodiments may preferably configure the compressibility response to be at 15% for the pressure changes between Pa and Pb. These pressure changes may be in the range between 15 psi and 10,000 psi, or between 3,000 psi and 10,000 psi, or between 3,000 psi and 6,000 psi.

As part of selecting a compressibility response, the step of Box 645 may include designing the compressible particles to have an optimum pressure performance at an upper end of the range of expected pressures. The step of Boxes 640 and 645 together will involve selecting a depth or depths at which the packings of compressible particles are to be placed.

Figure 7B:
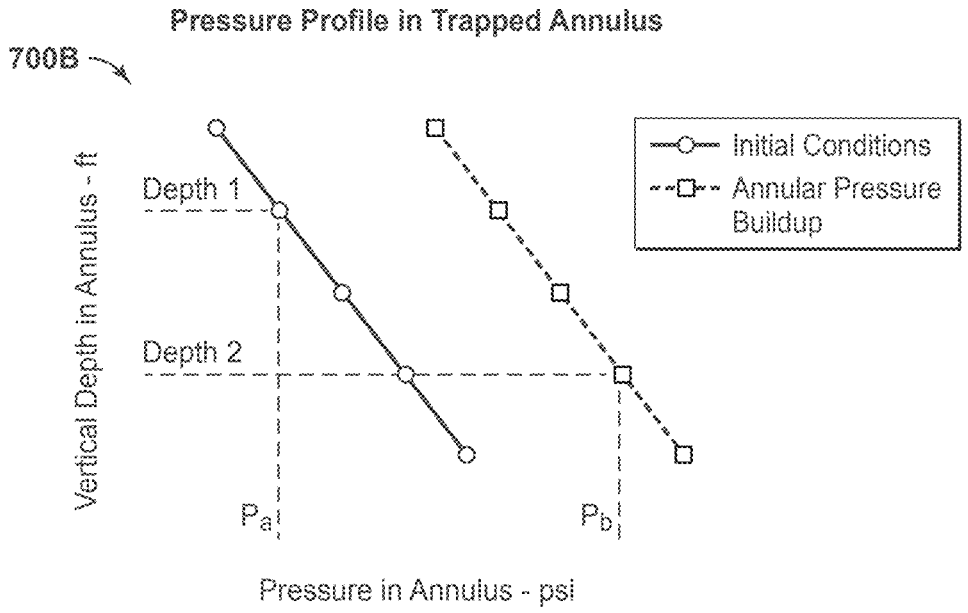
FIG. 7B is a graph showing a pressure profile within the annular region of a wellbore. Pressure is shown as a function of depth, both before and after pressure build-up due to production operations.

FIG. 7B is a graph 700B showing a pressure profile within the annular region of a wellbore. Vertical depth within the annulus is shown on the y-axis, measured in feet, while pressure in the annulus is shown on the x-axis, measured in psi. Once again, the pressure values $P_A$ and $P_B$ are indicated, meaning pressure both before and after pressure build-up.

Two different depths are shown in FIG. 7B, referenced as Depth 1 and Depth 2. Depth 1 indicates an upper portion of a trapped annulus while Depth 2 indicates a lower portion of a trapped annulus. Depth 2 is obviously lower than Depth 1. Further, annular pressure buildup or pressure conditions after pressure buildup is shown by the line having square, while the initial conditions or initial pressure conditions are shown by the line having circles.

Returning to FIG. 6, the method 600 additionally includes placing a column of cement around the second string of casing below the first depth. This is shown at Box 650. Then, a wellhead is placed over the wellbore, thereby forming a trapped annulus in the wellbore over the annular region. This is indicated at Box 670. A fluid mixture resides within the trapped annulus around the packing of compressible material.

The method 600 may then further comprise: placing a string of production tubing into the wellbore within the second string of casing (shown at Box 660); producing hydrocarbon fluids from the wellbore (shown at Box 680); and in response to thermal expansion of the fluid mixture in the trapped annulus, absorbing increased pressure using the compressible particles (shown at Box 690).

In connection with the method 600, the operator may select properties of the compressible particles. In the case where the compressible particles are secured within a cross-linked polymer or other binder, the operator may select particle size, particle diameter, and a compressibility response. In the case where the compressible particles are separate particles that are bundled into a compliant sleeve, the operator may select particle size, particle diameter, composition of the inner core, composition of the outer shell, porosity of the outer shell, and a compressibility response of the inner core.

As noted, the compressibility response is preferably optimized for the expected range of pressures. To this end, the following additional steps may be taken: determining a range of pressures expected to be experienced by the fluid mixture in the trapped annulus; and determining a maximum pressure for effectiveness of the compressible particles.

In one aspect, the method 600 further comprises determining an optimum length of the packings, or determining an optimum spacing of the packings, or determining an optimum number of the packings, or combinations thereof, for absorbing pressure build-up within the trapped annulus.

Referring again to the compressible particles, each of the particles may comprise carbon. At least some of the compressible particles may comprise graphite or graphene beads. In one embodiment, each of the compressible particles comprises a porous graphite carbon (PGC) material. In this instance, an inner core is composed of amorphous carbon, while an outer shell is composed of graphitic carbon. Both the inner core and the outer shell are porous.

Preferably, each compressible particle has an optimum pressure performance within the expected range of pressures.

Particles having a variety of outer diameters may be employed. For example, some particles may have a circular profile while others may have an oval profile. This enhances the ability of the particles to sense pressure changes and to compress more uniformly. Particles having a variety of porosity value may also be selected. In one aspect, the compressible particles have an average porosity of between 30% and 40%. This does not include any porosity that is open to fluid/gas ingress. The carbon matrix with closed pores may have a density of about 1.49 grams per cubic centimeter (g/cc), while a graphitic matrix may have a density as high as 2.26 g/cc.

As can be seen, a unique method for attenuating pressure in a trapped annulus is provided. The method takes advantage of the use of a packing of compressible particles fixed along a joint of casing within a wellbore. The packing allows the operator to select the depth at which the particles are placed along the trapped annulus without having to worry about free particles floating to the top of the column or settling at the bottom of the column along the trapped annulus. Stated another way, the operator can use particles 240 having a desired compressibility without worrying about bed heights at the bottom or the top of the annulus. Since the particles are contained, the bed height is generally pre-determined by the height of the packings, the depths of the packings and the number of tubular bodies employed in series. Further, the operator may be less concerned with particle density since buoyancy is not a factor.

To alleviate APB and to protect the adjacent casing strings, the particles are volumetrically compressed. This results in additional volume into which the fluid can expand as the pressure increases during production operations.

Beneficially, the carbon particles are run into the wellbore attached to the casing, and are not circulated down the casing, to the bottom of the well and back up the annulus. This prevents the carbon particles from seeing a maximum hydrostatic pressure in the wellbore, which could cause the particles to become pre-compressed or to experience residual strain that prevents them from functioning properly. By reducing the maximum pressure the carbon particles see prior to shutting them in the annulus, the amount of mitigation the carbon particles are expected to provide is enhanced. Additionally, because the carbon particles are placed at designated depths, the operator is able to optimize the zone of a compressibility curve wherein the carbon particles reside.

In other embodiments, the porous filter may be, for example, a rigid screen similar to a sand screen or a slotted liner, which may include various lengths and designs. For example, the filter may be between 5 feet (ft) and 35 feet in length, or other lengths, as well. Further, examples may be found in U.S. patent application Ser. No. 16/681,741, which is titled "Tubular Body Containing Particles, and Method of Attenuating Annular Pressure"; U.S. patent application Ser. No. 16/681,710, which is titled "Buoyant Particles Designed For Compressibility"; U.S. patent application Ser. No. 16/681,725, which is titled "Method of Placing a Fluid Mixture Containing Compressible Particles Into a Wellbore"; U.S. patent application Ser. No. 16/681,735, which is titled "Fluid Mixture Containing Compressible Particles"; and U.S. patent application Ser. No. 16/681,696, which is titled "Method of Designing Compressible Particles Having Buoyancy in a Confined Volume." Each of these applications is incorporated herein by reference in its entirety.

In support of the method of designing compressible particles for a fluid mixture as described herein, the embodiments may include various modifications and alternative forms, such as the following embodiments as noted in paragraphs 1 to 19:

1. A method of attenuating annular pressure buildup within a wellbore, comprising: running a first string of casing into a wellbore, the first string of casing extending into a subsurface to a first depth; running a second string of casing into the wellbore, the second string of casing extending into the subsurface to a depth that is greater than the first depth, and wherein the first string of casing surrounds an upper portion of the second string of casing forming an annular region; providing one or more packings of compressible material fixed at selected depths within the annular region, wherein the compressible material is designed to absorb pressure in response to thermal expansion of wellbore fluids within the annular region during the production of hydrocarbon fluids from the wellbore; placing a column of cement around the second string of casing below the first depth; and placing a wellhead over the wellbore, thereby forming a trapped annulus in the wellbore over the annular region; and wherein the compressible material in each of the one or more packings comprises a plurality of individual compressible particles, with the compressible particles together having a reversible volumetric contraction of ≥3% at pressures progressing from 3,000 pounds per square inch (psi) up to 10,000 psi (or for pressure changes from 3,000 psi to 10,000 psi (or from 15 psi to 10,000 psi) or when acted upon by a hydrostatic fluid pressure that increases from 3,000 psi to 10,000 psi (or from 15 psi to 10,000 psi)).

2. The method of paragraph 1, wherein: a fluid mixture resides within the trapped annulus around the packings of compressible material; and each of the one or more packings of compressible material is affixed to (i) an outer diameter of the second string of casing, or (ii) pup joints threadedly connected to the second string of casing, in series.

3. The method of paragraph 2, wherein: the compressible material with each of the one or more packings is between 5 feet and 35 feet in length; and the method further comprises mechanically or adhesively placing each of the one or more packings of compressible material along the second string of casing before the second string of casing is run into the wellbore.

4. The method of any of paragraphs 1 to 3, wherein: each of the plurality of particles comprises calcined petroleum coke and sulfur; and the one or more packings comprises at least three packings spaced apart along the second string of casing.

5. The method of any of paragraphs 1 to 3, wherein: the plurality of compressible particles in each of the one or more packings comprise carbonaceous particulate material held together forming a sheet; the sheet of each of the one or more packings comprises a binder for holding the compressible particles as a matrix; and the sheet of each of the one or more packings of compressible material is adhesively or frictionally secured to the outer diameter of respective pipe joints along the second string of casing.

6. The method of paragraph 5, wherein the binder comprises silicone, nitrile butadiene rubber (NBR), and fluoroelastomer (FKM), hydrogenated nitrile butadiene rubber (HNBR), or a soft plastic to form the matrix.

7. The method of any of paragraphs 1 to 3, wherein each of the one or more packings of compressible material comprises: an elastomeric sleeve placed along the outer diameter of a second string of casing; an upper collar securing the sleeve to the second string of casing at an upper end of the sleeve; a lower collar securing the sleeve to the second string of casing at a lower end of the sleeve; and a plurality of compressible particles held within the elastomeric sleeve.

8. The method of paragraph 7, wherein the sleeve is fabricated from neoprene, polyurethane rubber, vinyl, nitrile rubber, butyl rubber, silicone rubber, or combinations thereof.

9. The method of paragraph 7, wherein the sleeve is fabricated from a compliant polymeric material having micropores that permit an ingress of wellbore fluids 10. The method of any of paragraphs 1 to 3, wherein each of the one or more packings of compressible material comprises: an elongated rigid porous filter secured along the outer diameter of the second string of casing, or threadedly placed in series with the second string of casing; and a plurality of compressible particles held within the porous filter.

11. The method of paragraph 10, wherein the porous filter of each of the one or more packings comprises a sand screen or a slotted tubular joint, and is fabricated from metal or ceramic.

12. The method of any of paragraphs 1 to 3, wherein: each of the compressible particles has an outer diameter that is between 100 μm and 900 μm (in dry state) (or may between 40 micrometer (μm) and 1300 μm (in dry state)); and the compressible particles together have a compressibility of between 10% and 30%, when increasing pressure from 0 psi up to 10,000 psi (or increasing pressure from 15 psi (atmospheric pressure) to 10,000 psi or for pressure changes from 3,000 psi to 10,000 psi (or from 15 psi to 10,000 psi) or when acted upon by a hydrostatic fluid pressure that increases from 3,000 psi to 10,000 psi (or from 15 psi to 10,000 psi)).

13. The method of any of paragraphs 1 to 3, further comprising: placing a string of production tubing into the wellbore within the second string of casing; producing hydrocarbon fluids from the wellbore; and in response to thermal expansion of the fluid mixture in the trapped annulus, absorbing increased pressure using the compressible particles.

14. The method of any of paragraphs 1 to 3, further comprising: determining a range of pressures expected to be experienced by the fluid mixture in the trapped annulus; and determining a maximum pressure for effectiveness of the compressible particles.

15. The method of paragraph 14, further comprising: designing the compressible particles to have an optimum pressure performance at an upper end of the range of expected pressures.

16. The method of any of paragraphs 1-3, wherein: the one or more packings comprise at least three packings; and the method further comprises determining an optimum length of the packings, an optimum spacing of the packings, an optimum number of the packings, or combinations thereof, for absorbing pressure build-up within the trapped annulus.

17. A method of placing compressible particles within a wellbore, comprising: running a first string of casing into a wellbore, the first string of casing extending into a subsurface to a first depth; running a second string of casing into the wellbore, the second string of casing extending into the subsurface to a depth that is greater than the first depth, and wherein the first string of casing surrounds an upper portion of the second string of casing forming an annular region; providing a series of packings of compressible material, with each packing being fixed at a selected depth within the annular region, wherein: each packing of compressible material is affixed to an outer diameter of the second string of casing or is threadedly placed in series with the second string of casing, the compressible material comprises a plurality of carbonaceous particles, and the carbonaceous particles are designed to absorb pressure in response to thermal expansion of wellbore fluids within the annular region during the production of hydrocarbon fluids from the wellbore; placing a column of cement around the second string of casing below the first depth; and placing a wellhead over the wellbore, thereby forming a trapped annulus in the wellbore over the annular region.

18. The method of paragraph 17, wherein: the carbonaceous particles are designed to have an optimum pressure performance at an upper end of the range of expected pressures; the plurality of compressible particles together have a reversible volumetric contraction of ≥3% at pressures progressing from 3,000 psi up to 10,000 psi (or for pressure changes from 3,000 psi to 10,000 psi (or from 15 psi to 10,000 psi) or when acted upon by a hydrostatic fluid pressure that increases from 3,000 psi to 10,000 psi (or from 15 psi to 10,000 psi)); the packing of compressible material is between 5 feet and 35 feet in length; and the method further comprises securing each of the packings to an outer diameter of a joint along the second string of casing before the second string of casing is run into the wellbore, or threadedly connecting each of the packings to the second string of casing, in series; and wherein the method further comprises determining an optimum length of the packings, an optimum spacing of the packings, an optimum number of the packings, or combinations thereof, for absorbing pressure build-up within the trapped annulus.

19. A packing of compressible particles, comprising: a plurality of particles residing within a matrix and defining a cylindrical body having an upper end and a lower end; and wherein: the plurality of particles are held together by means of a binder, forming a sheet that is folded to form the cylindrical body; the plurality of particles together have a reversible volumetric expansion/contraction of ≥3% at pressures between 3,000 psi and up to 10,000 psi (or for pressure changes from 3,000 psi to 10,000 psi (or from 15 psi to 10,000 psi) or when acted upon by a hydrostatic fluid pressure that increases from 3,000 psi to 10,000 psi (or from 15 psi to 10,000 psi)), the cylindrical body is between five (5) feet and thirty-five (35) feet in length, and the cylindrical body is frictionally or adhesively secured to an outer diameter of a pipe joint.

Further variations of the method of designing compressible particles within a trapped annulus herein may fall within the spirit of the claims, below. It will be appreciated that the inventions are susceptible to modification, variation and change without departing from the spirit thereof.

We claim:

1. A method of attenuating annular pressure buildup within a wellbore, comprising:

running a first string of casing into a wellbore, the first string of casing extending into a subsurface to a first depth;

running a second string of casing into the wellbore, the second string of casing extending into the subsurface to a depth that is greater than the first depth, and wherein the first string of casing surrounds an upper portion of the second string of casing forming an annular region;

providing one or more packings of compressible material fixed at selected depths within the annular region, wherein the compressible material is designed to absorb pressure in response to thermal expansion of wellbore fluids within the annular region during the production of hydrocarbon fluids from the wellbore;

placing a column of cement around the second string of casing below the first depth; and placing a wellhead over the wellbore, thereby forming a trapped annulus in the wellbore over the annular region;

and wherein the compressible material in each of the one or more packings comprises a plurality of individual compressible particles, with the compressible particles together having a reversible volumetric contraction of greater than or equal to (≥) 3% at pressures progressing from 3,000 pounds per square inch (psi) up to 10,000 psi, wherein the plurality of compressible particles having a resiliency between exceeding 100% to 120% 100%, and wherein the compressible material is inert to heated wellbore fluids.

2. The method of claim 1, wherein:

a fluid mixture resides within the trapped annulus around the packings of compressible material; and each of the one or more packings of compressible material is affixed to (i) an outer diameter of the second string of casing, or (ii) pup joints threadedly connected to the second string of casing, in series.

3. The method of claim 2, wherein:

the compressible material with each of the one or more packings is between 5 feet and 35 feet in length;

and the method further comprises mechanically or adhesively placing each of the one or more packings of compressible material along the second string of casing before the second string of casing is run into the wellbore.

4. The method of claim 1, wherein:

each of the plurality of particles comprises calcined petroleum coke and sulfur; and the one or more packings comprises at least three packings spaced apart along the second string of casing.

5. The method of claim 1, wherein:

the plurality of compressible particles in each of the one or more packings comprise carbonaceous particulate material held together forming a sheet;

the sheet of each of the one or more packings comprises a binder for holding the compressible particles as a matrix; and the sheet of each of the one or more packings of compressible material is adhesively or frictionally secured to the outer diameter of respective pipe joints along the second string of casing.

6. The method of claim 5, wherein the binder comprises at least one of silicone, nitrile butadiene rubber (NBR), fluoroelastomer (FKM), hydrogenated nitrile butadiene rubber (HNBR), or a soft plastic to form the matrix.

7. The method of claim 1, wherein each of the one or more packings of compressible material comprises:

an elastomeric sleeve placed along the outer diameter of a second string of casing;

an upper collar securing the sleeve to the second string of casing at an upper end of the sleeve;

a lower collar securing the sleeve to the second string of casing at a lower end of the sleeve; and a plurality of compressible particles held within the elastomeric sleeve.

8. The method of claim 7, wherein the sleeve is fabricated from neoprene, polyurethane rubber, vinyl, nitrile rubber, butyl rubber, silicone rubber, or combinations thereof.

9. The method of claim 7, wherein the sleeve is fabricated from a compliant polymeric material having micro-pores that permit an ingress of wellbore fluids.

10. The method of claim 1, wherein each of the one or more packings of compressible material comprises:

an elongated rigid porous filter secured along the outer diameter of the second string of casing, or threadedly placed in series with the second string of casing; and a plurality of compressible particles held within the porous filter.

11. The method of claim 10, wherein the porous filter of each of the one or more packings comprises a sand screen or a slotted tubular joint, and is fabricated from metal or ceramic.

12. The method of claim 1, wherein:

each of the compressible particles has an outer diameter that is between 100 micrometers (μm) and 900; and the compressible particles together have a compressibility of between 10% and 30%, when increasing pressure from 15 psi up to 10,000 psi.

13. The method of claim 1, further comprising:

placing a string of production tubing into the wellbore within the second string of casing;

producing hydrocarbon fluids from the wellbore; and in response to thermal expansion of the fluid mixture in the trapped annulus, absorbing increased pressure using the compressible particles.

14. The method of claim 1, further comprising:

determining a range of pressures expected to be experienced by the fluid mixture in the trapped annulus; and determining a maximum pressure for effectiveness of the compressible particles.

15. The method of claim 14, further comprising:

designing the compressible particles to have an optimum pressure performance at an expected pressure.

16. The method of claim 1, wherein:

the one or more packings comprise at least three packings;

and the method further comprises determining an optimum length of the packings, an optimum spacing of the packings, an optimum number of the packings, or combinations thereof, for absorbing pressure build-up within the trapped annulus.

17. A method of placing compressible particles within a wellbore, comprising:

running a first string of casing into a wellbore, the first string of casing extending into a subsurface to a first depth;

running a second string of casing into the wellbore, the second string of casing extending into the subsurface to a depth that is greater than the first depth, and wherein the first string of casing surrounds an upper portion of the second string of casing forming an annular region;

providing a series of packings of compressible material, with each packing being fixed at a selected depth within the annular region, wherein:

each packing of compressible material is affixed to an outer diameter of the second string of casing or is threadedly placed in series with the second string of casing, the compressible material comprises a plurality of carbonaceous particles, the carbonaceous particles are designed to absorb pressure in response to thermal expansion of wellbore fluids within the annular region during the production of hydrocarbon fluids from the wellbore;

the carbonaceous particles having a resiliency between exceeding 100% to 120%; and the compressible material is inert to heated wellbore fluids;

placing a column of cement around the second string of casing below the first depth; and placing a wellhead over the wellbore, thereby forming a trapped annulus in the wellbore over the annular region.

18. The method of claim 17, wherein:

the carbonaceous particles are designed to have an optimum pressure performance at an expected pressure;

the plurality of compressible particles together have a reversible volumetric contraction of greater than or equal to (≥) 3% at pressures progressing from 3,000 pounds per square inch (psi) up to 10,000 psi;

the packing of compressible material is between 5 feet and 35 feet in length; and the method further comprises securing each of the packings to an outer diameter of a joint along the second string of casing before the second string of casing is run into the wellbore, or threadedly connecting each of the packings to the second string of casing, in series;

and wherein the method further comprises determining an optimum length of the packings, an optimum spacing of the packings, an optimum number of the packings, or combinations thereof, for absorbing pressure build-up within the trapped annulus.

19. A packing of compressible particles, comprising:

a plurality of particles residing within a matrix and defining a cylindrical body having an upper end and a lower end;

and wherein:

the plurality of particles are held together by means of a binder, forming a sheet that is folded to form the cylindrical body, wherein the sheet is inert to heated wellbore fluids;

the plurality of particles together have a reversible volumetric contraction of greater than or equal to (≥) 3% at pressures progressing from 3,000 pounds per square inch (psi) up to 10,000 psi, the plurality of particles having a resiliency between exceeding 100% to 120%;

the cylindrical body is between 5 and 35 feet in length, and the cylindrical body is frictionally or adhesively secured to an outer diameter of a pipe joint.

* * * * *